United States Patent [19]

Evans et al.

[11] Patent Number: 4,858,507

[45] Date of Patent: Aug. 22, 1989

[54] MAT BOARD CUTTER WITH ADJUSTABLE CUTTER-CARRYING BODY

[75] Inventors: Louis B. Evans, Afton Twp., Washington County, Minn.; Daniel D. Smith, Castelwoods, Miss.

[73] Assignee: Esselte Pendaflex Corporation, Garden City, N.Y.

[21] Appl. No.: 486,896

[22] Filed: Apr. 20, 1983

[51] Int. Cl.[4] ..... B26D 3/02; B26D 7/02

[52] U.S. Cl. ..... 83/455; 83/581; 83/614; 83/824

[58] Field of Search ..... 83/455, 456, 464, 468, 83/614, 564, 581, 745, 824; 308/4 R, 4 C

[56] References Cited

U.S. PATENT DOCUMENTS

| | | | |
|---|---|---|---|
| 2,253,086 | 8/1941 | McCarthy | 83/455 |
| 3,385,149 | 5/1968 | Johnson | 83/455 |
| 3,964,360 | 6/1976 | Schwartz | 83/468 |
| 3,996,827 | 12/1976 | Logan | 83/614 |
| 4,018,118 | 4/1977 | Goff | 83/468 |
| 4,036,486 | 7/1983 | Molpus | 269/303 |

FOREIGN PATENT DOCUMENTS

| | | |
|---|---|---|
| 115698 | 1/1946 | Sweden . |
| 548782 | 10/1942 | United Kingdom . |

*Primary Examiner*—Frank Y. Yost
*Assistant Examiner*—Hien H. Phan
*Attorney, Agent, or Firm*—Darby & Darby

[57] ABSTRACT

A mat board cutter in which a cutter-carrying body has an end-to-end slot that affords adjustment by screws extending across the slot to bring bearing surfaces on the body into close-fitting relatively slideable engagement with a guide rail on which the body is slidably mounted.

1 Claim, 2 Drawing Sheets

MAT BOARD CUTTER WITH ADJUSTABLE CUTTER-CARRYING BODY

TECHNICAL FIELD

The present invention relates to mat board cutters, and particularly to means for adjusting the accuracy with which a cutter-carrying body slides along a guide rail on such a mat board cutter.

BACKGROUND ART

U.S. Pat. No. 4,036,486, incorporated herein by reference, describes a mat board cutter by which a mat board is cut to have a desired peripheral size to fit within a desired frame and to have a desired central opening through which a picture being framed is visible.

As described in greater detail in U.S. Pat. No. 4,036,486 cutting the mat board requires sliding a cutter-carrying body along a guide rail with a knife on a cutter device pivotably carried on the body in engagement with the mat, which mat is held in a predetermined position by abutment means on a base and a clamp bar on which the guide rail is mounted. Sliding engagement between the body and guide rail is afforded by boring the body to provide a cylindrical bearing surface defining a through opening receiving a peripheral guide surface on the rail. The body is bored to initially provide close-fitting engagement between the bearing and guide surfaces. With use, however, wear on one of the surfaces (normally the bearing surface on the body which is made of a softer material, such as brass, then the guide rail which is typically made of steel) can allow the body to move out of its intended path so that cuts made by the knife are not as straight as may be desired.

Such wear has been compensated for on prior art cutter-carrying bodies by attaching plates on the ends of the body with screws, with arcuate edges of the plates bearing against sides of the guide surface. Such plates, however, are both, expensive and difficult to adjust.

SUMMARY OF THE INVENTION

The present invention provides a cutter-carrying body for a mat board cutter of the type described above that is easily adjustable to bring a bearing surface of the block into close fitting engagement with a guide surface of a guide rail to afford accurate sliding movement therebetween without the need to use plates at the ends of the body.

According to the present invention there is provided an improved mat board cutter of the type having a base with abutment means for positioning a mat board thereon, a clamp bar for clamping the mat board on the base, a guide rail on the clamp bar having a peripheral guide surface, a cutter-carrying body having spaced ends and a bearing surface defining a through opening between its ends receiving the guide rail in close-fitting relationship so that the bearing surfaces can slide along and be accurately guided by the peripheral guide surface, and at least one cutter device including a knife which is pivotably mounted on the cutter-carrying body for movement between a disengaged position with the knife spaced from the mat board and an engaged position with the knife engaged with the mat board.

The improved cutter-carrying body has spaced opposed surfaces defining a slot extending between its ends and communicating along one edge with the through opening, and means for adjusting the spacing between the opposed surfaces to position the bearing and guide surfaces in close-fitting relationship.

Preferably the cutter-carrying body is of one-piece construction and has a portion bridging the edge of the slot opposite the through opening that is sufficiently flexible to afford adjusting the spacing between the opposed surfaces defining the slot, and the means for adjusting the spacing between those opposed surfaces comprises at least one screw threadably engaged with the body and extending across the slot between the opposed surfaces.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
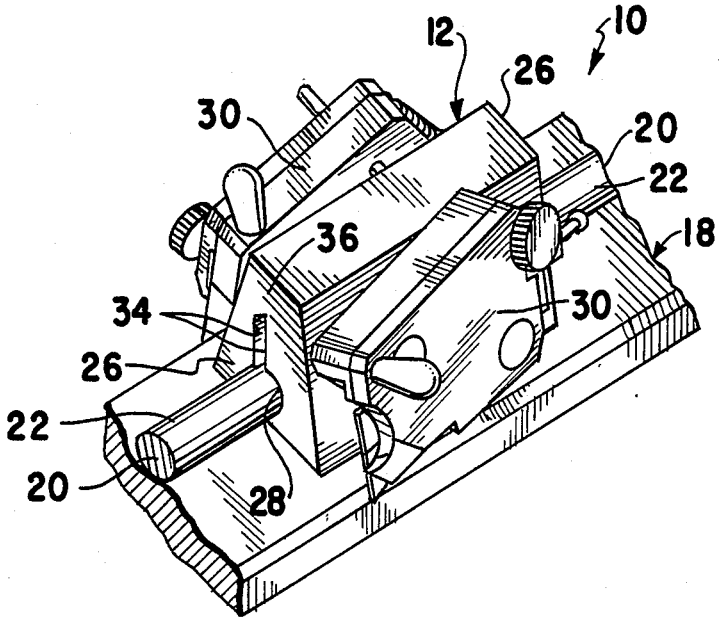
FIG. 1 is a fragmentary perspective view of a mat board cutter including a cutter-carrying body according to the present invention.

Referring now to the drawing there is shown a mat board cutter 10 including an improved cutter-carrying body 12 according to the present invention.

The mat board cutter 10 is essentially the same as the mat board cutter described in U.S. Pat. No. 4,036,486, incorporated herein by reference, in that it comprises a base (13) with abutment means members 14 and 15 for positioning a mat thereon; a clamp bar 18 for clamping the mat board 16 on the base 13; a guide rail 20 fixed on the clamp bar 18 having a cylindrical peripheral guide surface 22; the cutter-carrying body 12 which has spaced ends 26 and a bearing surface 28 defining a through opening between its ends 26, which bearing surface 28 receives the guide rail 20 in close-fitting relationship so that the bearing surface 28 of the body 12 can slide along and will be guided by the peripheral guide surface 22 of the guide rail 20; and two cutter devices 30 each including a knife 32 and being pivotably mounted on a side surface of the cutter-carrying body 12 for pivotal movement between a disengaged position with the knife 32 spaced from the mat board, and an engaged position with the knife 32 engaged with the mat board.

Figure 2:
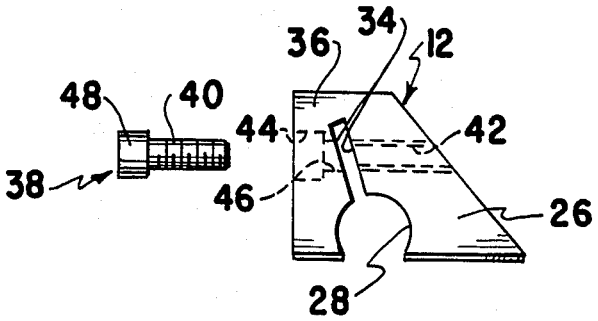
FIG. 2 is an end view of the cutter-carrying body of FIG. 1 shown separated from the mat board cutter-carrying.
Figure 3:
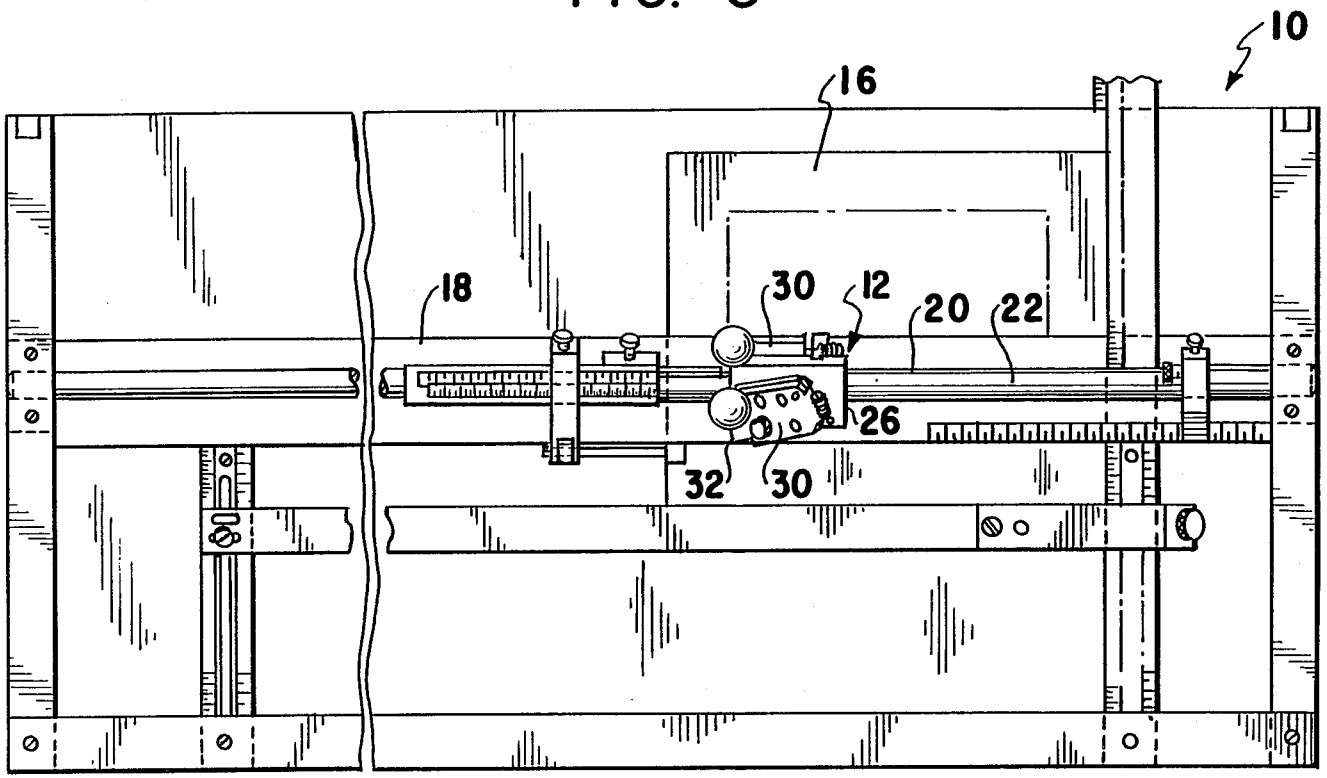
FIG. 3 is a plan view of the mat board cutter of FIG. 1.

As is best seen in FIG. 2, the improved cutter-carrying body 12 has spaced opposed surfaces 34 defining a slot extending between its ends 26 and communicating along one edge with the through opening defined by the bearing surface 28 in which the guide rail 20 is received, and means for adjusting the spacing between the opposed surfaces 34 defining the slot to position the bearing and guide surfaces 28 and 22 in close-fitting relatively slidable relationship. As illustrated, the cutter-carrying body 12 is of one-piece construction of a suitable bearing metal (e.g.,manganese bronze) and has a portion 36 bridging the edge of the slot opposite the through opening, which portion 36 is flexible to afford adjusting the spacing between the opposed surfaces 34 defining the slot. The means for adjusting the spacing between the opposed surfaces 34 comprises two screws 38 (only one of which is shown) having threaded portions 40 engaged with threads along passageways 42 in the body 12 on one side of the slot, extending across the slot between the opposed surfaces 34, and having heads 48 and adjacent parts of their threaded portions received respectively in sockets 44 and bores 46 in the body 12 on the side of the slot opposite the threaded passageways 42. The sockets 44 restrict movement of the screw heads 48 toward the threaded passageways 42 and the bores 46 afford relative rotation of the threaded portions of the screws 38 therein so that the screws 38 can be rotated to draw the surfaces 34 defining the slot together. Also, as illustrated, the through opening between the ends 26 of the cutter-carrying body 12 opens through the side of the body 12 opposite the slot so that the bearing surface 28 is divided into opposed arcuate portions that can be moved together to engage the opposite sides of the guide surface 22 on the guide rail 20. Thus the screws 38 can be tightened to provide an initial close-fitting sliding relationship between the bearing and guide surfaces 28 and 22, and can subsequently be further tightened as needed to maintain such a relationship despite wear of one or both of the surfaces 28 or 22.

It will be appreciated that modifications can be made to the improved cutter-carrying body 12 without departing from the spirit of the present invention. For example, the body can include two pieces, in which case the slot could extend between the through opening and the peripheral surface of the body. Thus the scope of the present invention should not be limited to the structure of the body as illustrated, but should include all structures described by the language of the claims and their equivalents.

We claim:

1. In a mat board cutter having a base with means for positioning a mat board thereon, a clamp bar for clamping the mat board on said base, a guide rail on said clamp bar having a peripheral guide surface, a cutter-carrying body having spaced ends and a bearing surface defining a through opening between said ends receiving said guide rail in close-fitting relationship so that said bearing surface can slide along and be guided by said peripheral guide surface, and at least one cutter device including a knife and being pivotaly mounted on said cutter-carrying body for movement between a disengaged position with the knife spaced from the mat board and an engaged position with the knife engaged with the mate board, the improvement wherein:

said cutter carrying body is of one-piece construction, has spaced opposed surfaces defining a slot extending between said ends and communicating along one edge with said through opening, and has a portion bridging the edge of said slot opposite said through opening that is sufficiently flexible to afford adjusting the spacing between said opposed surfaces; and said cutter includes means for adjusting the spacing between said opposed surfaces to position said bearing and guide surfaces in close-fitting slideable relationship comprising two spaced screws threadably engaged with said body and extending across said slot between said opposed surfaces.

* * * * *